US009260890B2

(12) United States Patent
Harrison

(10) Patent No.: US 9,260,890 B2
(45) Date of Patent: Feb. 16, 2016

(54) LATCH MECHANISM

(71) Applicant: Craig Harrison, Gulf Breeze, FL (US)

(72) Inventor: Craig Harrison, Gulf Breeze, FL (US)

(73) Assignee: Daws Manufacturing Co., Inc., Pensacola, FL (US)

( * ) Notice: Subject to any disclaimer, the term of this patent is extended or adjusted under 35 U.S.C. 154(b) by 0 days.

(21) Appl. No.: 14/276,458

(22) Filed: May 13, 2014

(65) Prior Publication Data

US 2015/0330108 A1 Nov. 19, 2015

(51) Int. Cl.
*E05B 65/52* (2006.01)
*E05C 3/12* (2006.01)

(52) U.S. Cl.
CPC ..... *E05B 65/5284* (2013.01); *E05C 3/12* (2013.01)

(58) Field of Classification Search
CPC ..... E05B 65/5284; E05B 65/52; E05C 3/12
USPC ..... 292/20, 194–198, 200; 70/63, 70, 70/158–159, 162, 344, 78–84
See application file for complete search history.

(56) References Cited

U.S. PATENT DOCUMENTS

| | | | | |
|---|---|---|---|---|
| 1,789,775 | A | 1/1931 | Russ et al. | |
| 2,358,554 | A | 9/1944 | Bixel | |
| 2,665,156 | A | 1/1954 | Allen | |
| 3,439,948 | A | 4/1969 | Smith | |
| 3,745,796 | A | 7/1973 | Fleming | |
| 4,134,281 | A | 1/1979 | Pelcin | |
| 4,268,077 | A | 5/1981 | Bohleen et al. | |
| 4,930,325 | A | 6/1990 | Ramsauer | |
| 5,201,557 | A * | 4/1993 | Schlack | 292/161 |
| 5,234,238 | A | 8/1993 | Takimoto | |
| 5,286,073 | A | 2/1994 | Ui | |
| 5,299,844 | A | 4/1994 | Gleason | |
| 5,450,735 | A | 9/1995 | Esaki et al. | |
| 5,884,948 | A | 3/1999 | Weinerman et al. | |
| 6,115,239 | A * | 9/2000 | Kim | 361/679.57 |
| 6,174,007 | B1 | 1/2001 | Schlack et al. | |
| 6,490,896 | B2 | 12/2002 | Segawa | |
| 6,564,602 | B2 * | 5/2003 | Gregory | 70/360 |
| 6,637,785 | B2 | 10/2003 | Sugimoto | |
| 6,668,602 | B2 | 12/2003 | Graham et al. | |
| 6,719,332 | B2 | 4/2004 | Sekulovic | |
| 6,748,775 | B1 | 6/2004 | Bucker et al. | |
| 6,782,725 | B2 * | 8/2004 | Linares | 70/360 |
| 6,817,637 | B1 * | 11/2004 | Anderson | 292/340 |
| 6,857,298 | B2 * | 2/2005 | Linares | 70/159 |
| 6,913,297 | B2 | 7/2005 | Jackson et al. | |
| 6,962,375 | B2 * | 11/2005 | Linares | 292/201 |
| 6,973,810 | B2 | 12/2005 | Chen | |
| 7,013,689 | B2 | 3/2006 | Graham et al. | |
| 7,155,947 | B2 | 1/2007 | Bertani | |
| 7,272,964 | B2 | 9/2007 | Graham et al. | |
| 7,320,488 | B2 | 1/2008 | Hidding et al. | |
| 7,497,488 | B2 | 3/2009 | Chen | |
| 8,075,027 | B2 | 12/2011 | Zweibohmer | |
| 2003/0025338 | A1 | 2/2003 | Mori et al. | |
| 2008/0047308 | A1 | 2/2008 | Stuckey | |
| 2010/0127513 | A1 | 5/2010 | Akahane et al. | |
| 2010/0171324 | A1 | 7/2010 | Stapf | |
| 2012/0000255 | A1 * | 1/2012 | Nave et al. | 70/63 |

* cited by examiner

*Primary Examiner* — Christopher Boswell
*Assistant Examiner* — Amanda L Miller
(74) *Attorney, Agent, or Firm* — GrayRobinson, PA; Thomas L. Kautz

(57) ABSTRACT

A latch mechanism is provided for securing the lid of a container in a closed position having actuator components that facilitate latching and unlatching of a latch plate of the latch mechanism.

11 Claims, 4 Drawing Sheets

LATCH MECHANISM

FIELD OF THE INVENTION

This invention relates to latches, and, more particularly, to a latch mechanism for containers such as tool boxes mounted to the bed of a pickup truck.

BACKGROUND OF THE INVENTION

Latches are routinely used on doors, chests, cabinets and other containers where a lid or door must be retained in a closed and locked position. Typically, latches include a latch plate moveable between a latched position and an unlatched position. When unlatched, the latch plate may receive a striker pin mounted to the lid of a toolbox, for example, as the lid is moved to a closed position. Once the lid is closed, the latch plate moves to the latched position to capture the striker pin and retain the lid in the closed position. The latch may be provided with a lock to prevent the latch plate from releasing the striker pin except when unlocked.

A number of designs have been proposed in the prior art to move the latch plate from its latched position to the unlatched position wherein the striker pin may be released. One approach is disclosed in U.S. Pat. No. 6,973,810 in which a handle mounted to the housing of a latch is pivoted to set in motion a series of components that cooperate to move the latch plate to an unlatched position. In this and similar designs, a first end of the handle is pivotally mounted to the latch housing and its opposite, second end connects to one of the components that function to open the latch plate. The latch plate is opened by moving the second end of the handle to an unlatched position thus pivoting the handle about its first end. A substantial amount of force is required to pivot the latch handle because, as noted above, its second end is directly connected to the series of components that cooperate to open the latch plate.

SUMMARY OF THE INVENTION

This invention is directed to a latch mechanism for use in a container such as a truck box in which a latch rail mounted to the truck box houses components that facilitate latching and unlatching of a latch plate with much less force than is required in prior art designs of the type described above.

In one presently preferred embodiment, the latch mechanism of this invention comprises a latch rail which pivotally mounts a latch plate adapted to engage a striker pin when in a latched position, and a pawl lever which is pivotally mounted to the latch rail and operative to engage and retain the latch plate in the latched position except when acted upon by an actuator assembly. The actuator assembly comprises first and second slide blocks which are laterally movable within a cavity formed in the latch rail, first and second carriages each laterally movable within a separate opening in the latch rail which are located on either side of the cavity, and, a first actuator rod connected between the first carriage and the first slide block and a second actuator rod connected between the second carriage and the second slide block.

In response to lateral movement of the first carriage in a first direction, the first actuator rod and the first slide block move in the same first direction therewith. A first actuator arm carried by the first slide block is positioned to engage the pawl lever, and, in response to lateral movement of the first slide block, the first actuator arm pivots the pawl lever out of engagement with the latch plate allowing it to move to an unlatched position. Similarly, in response to lateral movement of the second carriage in a second direction, opposite to the first direction, the second actuator rod and the second slide block move in the same second direction therewith. A second actuator arm carried by the second slide block is positioned to engage the pawl lever, and, in response to lateral movement of the second slide block, the second actuator arm pivots the pawl lever thus allowing the latch plate to move to an unlatched position.

The first and second carriages may be positioned on opposite sides of the front wall of a truck box, for example, so that the latch mechanism may be moved to the unlatched position from either side of the box. Operation of the actuator assembly requires minimal force since the slide blocks and carriages readily slide in a lateral direction within the cavity and the openings, respectively, formed in the latch rail. Such components may be made of plastic or other smooth, low friction material to facilitate such movement. Each carriage may be provided with a finger tab, which is easily grasped by a user of the box, to effect lateral movement of the actuator assembly.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
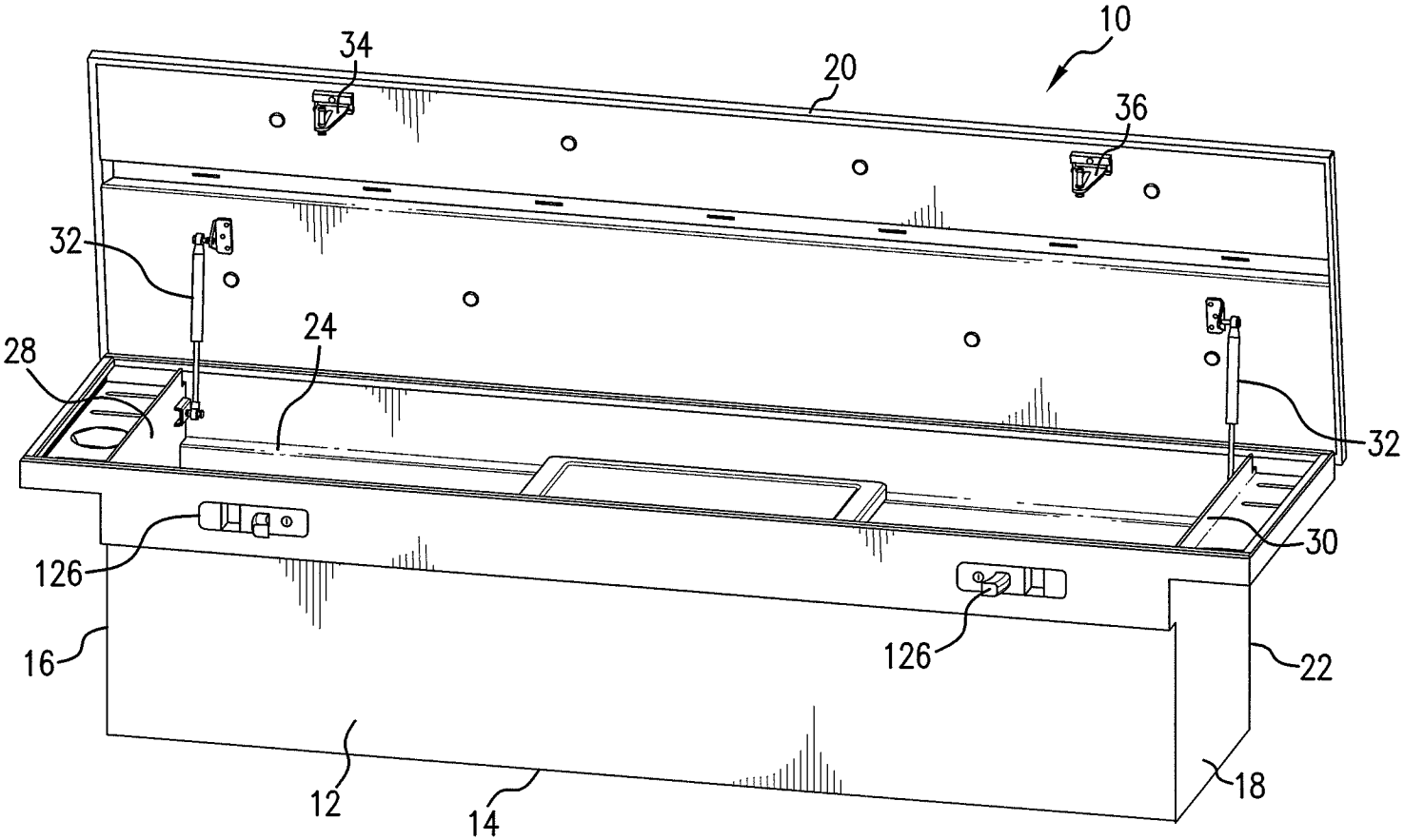
FIG. 1 is a perspective view of a truck box incorporating the latch mechanism of this invention.

Referring initially to FIG. 1, a truck box 10 is shown which comprises a front wall 12, a bottom wall 14, opposed end walls 16, 18, a top wall or lid 20 and a back wall 22. Each of the walls 12-22 is preferably formed of aluminum tread plate and they are interconnected by welding to foam a hollow interior 24. For purposes of illustration and the present discussion, a single lid, cross-over box is depicted in the Figs. but it is contemplated that other types of truck boxes may be employed with the lid of this invention, discussed below, including side-mount boxes, chest boxes, top mount boxes, trailer boxes, RV boxes and others.

The interior 24 of the truck box 10 may include a pair of plates 28, 30 located near respective end walls 16, 18. Each of the plates 28, 30 supports one end of a gas spring 32 which is mounted at its opposite end to the top wall 20. The top wall 20 also mounts a pair of spaced striker bars 34, 36.

Figure 2:
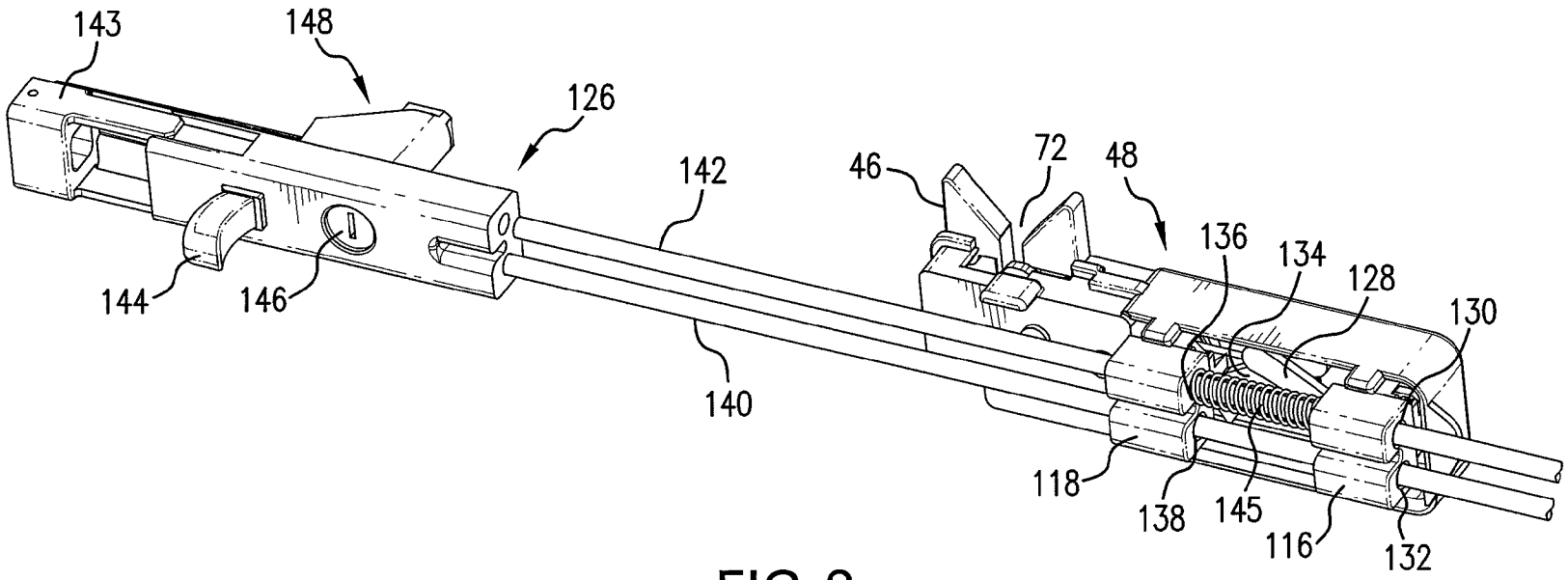
FIG. 2 is a perspective view of a portion of the latch mechanism depicting one of the carriages, the actuator rods and the slide blocks employed in the actuator assembly of this invention.
Figure 3A:
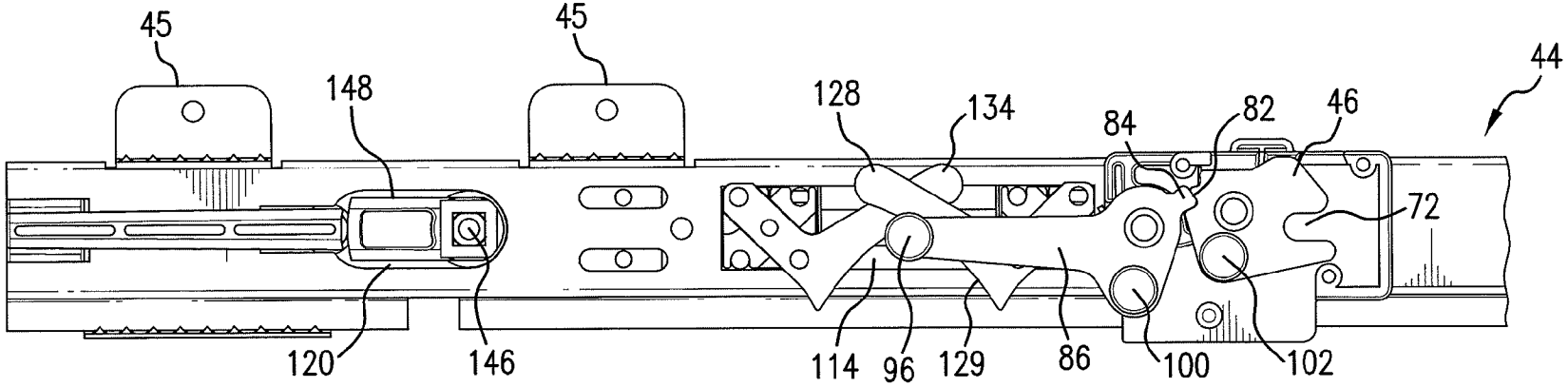
FIG. 3A is a rear elevational view of the latch mechanism in the latched position.
Figure 3B:
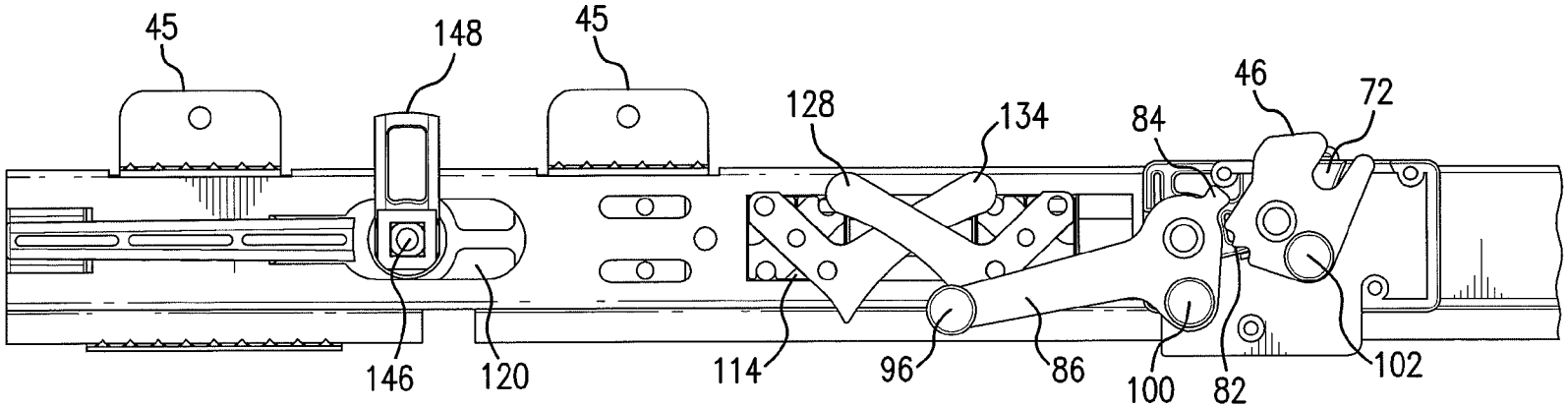
FIG. 3B is a view similar to FIG. 3A except with the latch mechanism in the unlatched position.
Figure 4:
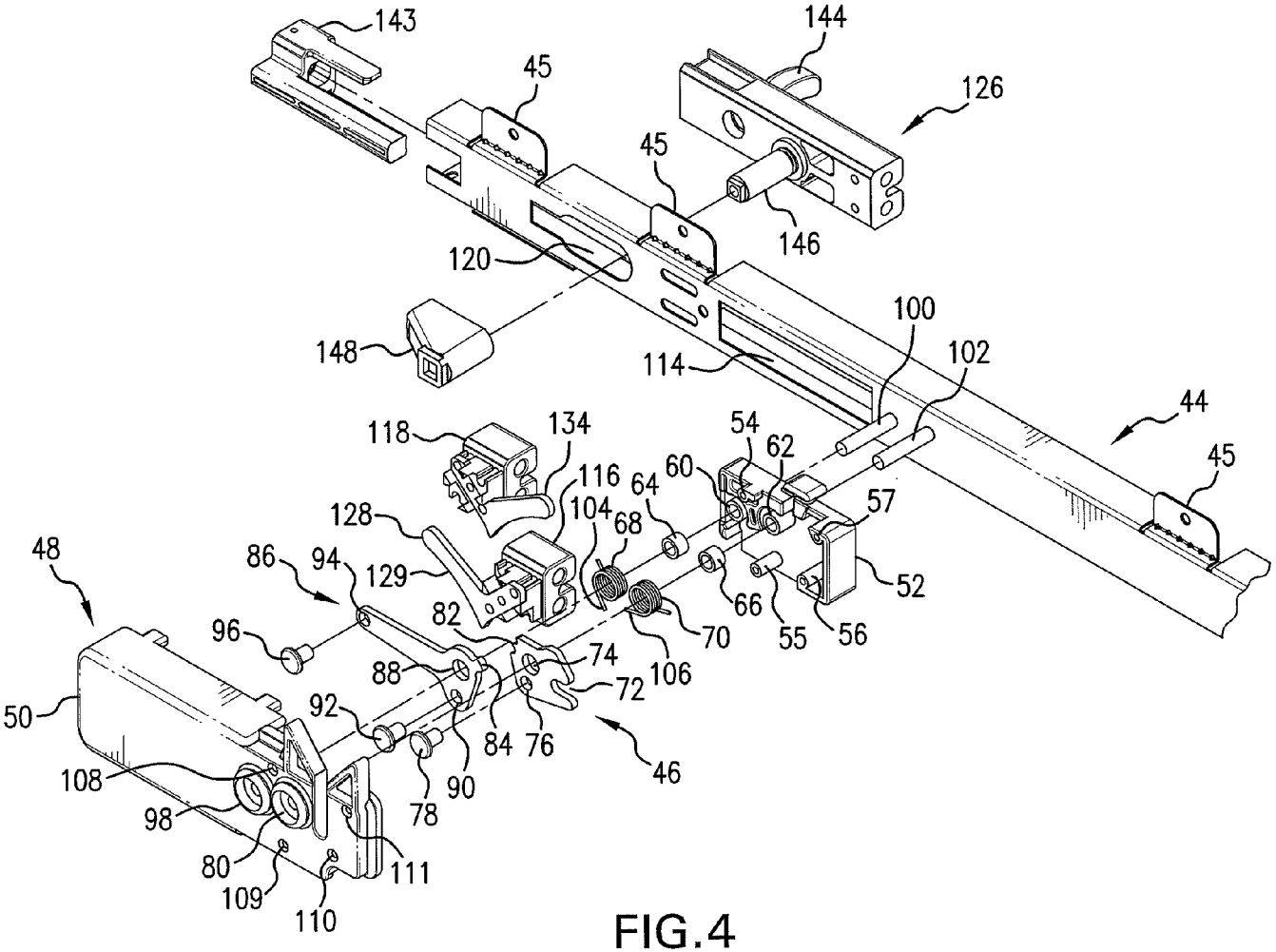
FIG. 4 is an exploded perspective view of a portion of the latch mechanism herein.

Referring now to FIGS. 2-4, the latch mechanism 42 of this invention is illustrated. The primary components of the latch mechanism 42 include a latch plate 46 and a pawl lever 86 both pivotally mounted to a rail 44 which is secured to the inner surface of the front wall 12 of the truck box 10 by tabs 45 in position for the latch plate 46 to align with one of the striker bars 34 or 36 carried by the box lid 20. For ease of illustration, only a portion of the latch rail 44 is illustrated in FIGS. 2-4, it being understood that the latch rail 44 extends substantially along the entire length of the front wall 12 of the truck box 10. As discussed below, structure for moving the latch plate 46 between an unlatched and latched position is provided along the front wall 12 near each of the box end walls 16, 18 for convenience and ease of operation. Additionally, for purposes of discussion, the terms "upper," "lower," "top," "bottom," "inner," "outer," "vertical" and "lateral" refer to the orientation of the truck box 10, and its walls 12-22, as viewed in the Figs. The term "lateral direction" refers to a direction generally between the end walls 16, 18 of the truck box 10.

As best seen in FIG. 4, the latch plate 46 is located within a latch housing 48 having a back cover 50 and a front compartment 52. The front compartment 52 includes mounting posts 54, 55, 56 and 57, and, a pair of spaced sleeves 60, 62. The sleeves 60, 62 align with spacers 64, 66 and return springs 68, 70, respectively. Preferably, the latch plate 46 is formed with a notch 72 for receiving a striker bar 34 or 36, a pass through bore 74 and an aperture 76 which mounts a spring retainer pin 78. The pass through bore 74 of the latch plate 46 aligns with sleeve 62, spacer 66, return spring 70 and a mount 80 carried by the back cover 50 of latch housing 48. The latch plate 46 is also formed with one or more gear teeth 82 which engage the locking pawl 84 of a pawl lever 86. The pawl lever 86 further includes a pass through bore 88, a first aperture 90 which mounts a spring retainer pin 92 and a second aperture 94 in which an actuator pin 96 is mounted. The pass through bore 88 of pawl lever 86 aligns with the sleeve 60 in the front compartment 52 of the latch housing 48, the spacer 64, return spring 68 and a mount 98 carried by the back cover 50 of latch housing 48.

The latch housing 48 and the components it contains are mounted to the latch rail 44 by first and second support rods 100 and 102. The support rod 100 extends through the sleeve 60 in front compartment 52, the spacer 64, the return spring 68 and the pass through bore 88 in pawl lever 86 into the mount 98 in the back cover 50 where it is secured in place. A finger 104 of the return spring 68 bears against the spring retainer pin 92 mounted to the pawl lever 86 urging it in a clockwise direction as viewed in the Figs., so as to retain the latch plate 46 in the latched position, as described below in connection with a discussion of the operation of latch mechanism 42. The support rod 102 extends through the sleeve 62 in the front compartment 52, the spacer 66, the return spring 70 and the pass through bore 74 in the latch plate 46 into the mount 80 in the back cover 50 where it is secured in place. A finger 106 of the return spring 70 bears against the spring retainer pin 78 mounted to the latch plate 46 urging it in a counterclockwise direction as view in the Figs. to the unlatched position. Fasteners (not shown) are extended through bores 108, 109, 110 and 111 formed in the back cover 50, and into aligning posts 54-57 in the front compartment 52, in order to connect the back cover 50 and front compartment 52 together along the latch rail 44.

Referring to FIGS. 2-4, the latch rail 44 is formed with a central cavity 114 which receives a first slide block 116 and a second slide block 118. A pair of stepped openings 120 are located on either side of the cavity 48, one of which is shown in the drawings. Each stepped opening 120 receives a carriage 126, which are preferably located near respective end walls 16, 18 of the truck box 10 for ease of access. See FIG. 1.

In the presently preferred embodiment, the first slide block 116 mounts an actuator arm 128 in position to engage the actuator pin 96 carried by the pawl lever 86. The first slide block 116 is formed with an upper bore 130 and a lower bore 132. Similarly, the second slide block 118 mounts an actuator arm 134 in position to engage the actuator pin 96. The second slide block 118 is formed with an upper bore 136 and a lower bore 138. A first actuator rod 140 is mounted to the carriage 126, and fixed within the lower bore 132 of first slide block 116, but it is slidable within the lower bore 138 in second slide block 118. A second actuator rod 142 is mounted to the carriage (not shown) on the opposite end of the truck box 10, and fixed within the upper bore 136 of second slide block 118, but is free to slide within the upper bore 130 of first slide block 116. The first and second slide blocks 116, 118 may be fixed to respective first and second actuator rods 140, 142 by any suitable means, including an E-clip secured within a groove formed in such rods 140, 142 (not shown). In the presently preferred embodiment, a return spring 145 is positioned in between the first and second slide blocks 116, 118 for purposes to become apparent below.

Each carriage 126 is laterally movable within the stepped opening 120 from a locked position depicted in FIG. 3A to an unlocked and open position shown in FIG. 3B where it engages an end cap 143 located at one end of the latch rail 44. The carriage 126 mounts a finger tab 144 which extends outwardly from the front wall 12 of the truck box 10, and a key cylinder 146 which extends into the stepped opening 120. The inner end of key cylinder 146 mounts a locking cap 148 which is rotatable between a locked and unlocked position.

The latch mechanism 42 operates as follows. Referring to FIG. 3A, the latch plate 46 is illustrated in the latched position wherein its notch 72 is oriented generally horizontally relative to the latch rail 44 and front wall 12 of the truck box 10 so that one of the striker bars 34 and 36 may be captured and retained within the notch 72 with the lid 20 closed. Although the return spring 70 acting on the latch plate 46 urges it in a counterclockwise direction, toward the unlatched position shown in FIG. 3B, the locking pawl 84 of the pawl lever 86 engages one of the gear teeth 82 on the latch plate 46 to retain it in the latched position since the pawl lever 86 is biased in the opposite direction by the return spring 68.

In order to allow the latch plate 46 to move to the unlatched position shown in FIG. 3B, several components interact with one another. Initially, the latch plate 46 may be in a locked position shown in FIG. 3A in which the locking cap 148 connected to the key cylinder 146 is oriented generally horizontally within the stepped opening 120. When locked, the locking cap 148 contacts an edge of the stepped opening 120 which prevents the carriage 126 from moving to the left as viewed in the Figs. A key (not shown) may be inserted into the key cylinder 146 to rotate it, and the locking cap 148, in a clockwise direction as viewed in FIG. 3B so that the locking cap 148 is oriented vertically relative to the latch rail 44 and disengages the end of the stepped opening 120. With the locking cap 148 unlocked, the finger tab 144 of the carriage 126 may be grasped by a user and moved laterally to the left as viewed in the Figs. until it engages the end cap 143. Because the first actuator rod 140 is fixed to the carriage 126, it moves in the same lateral direction therewith. In turn, since the first slide block 116 is fixed to the first actuator rod 140 it too moves in the lateral direction within the cavity 114. Although the first actuator rod 140 enters the lower bore 138 of the second slide block 118, it is free to slide therein and therefore the second slide block 118 remains in position when the carriage 126 depicted in the Figs. is moved. In the course of movement of the first slide block 116, the force applied to the carriage 126 though the finger tab 144 overcomes the spring force exerted by the return spring 145 positioned between the slide blocks 116, 118 and compresses such spring 145 against the second slide block 118.

As shown in FIG. 3A, a side edge 129 of the first actuator arm 128 mounted to the first slide block 118 rests against the actuator pin 96 on the pawl lever 86. In response to movement of the first slide block 116 laterally to the left as viewed in FIGS. 3A and 3B, the side edge 129 of first actuator arm 128 bears against the actuator pin 96 forcing it in a generally downward direction. See FIG. 3B. The pawl lever 86 rotates in a counterclockwise direction about the support rod 100 as its actuator pin 96 moves downwardly, which causes the locking pawl 84 of the pawl lever 86 to disengage one of the gear teeth 82 in the latch plate 46. Under the influence of return spring 70, once disengaged by the locking pawl 84 of the pawl lever 86 the latch plate 46 rotates on support rod 102 in a counterclockwise direction to the unlatched position shown in FIG. 3B. This releases the striker bar 34 or 36 allowing the top wall 20 to be opened. Upon movement of the latch plate 46 to the unlatched position, the return spring 145 is allowed to uncoil and return the slide blocks 116, 118 to their original, spaced apart position shown in FIGS. 2 and 3A.

When the top wall 20 is closed, one of the striker bars 34 or 36 enters the notch 72 in the latch plate 46 rotating it in the clockwise direction and into a latched position wherein the locking pawl 84 of the pawl lever 86 engages one of the gear teeth 82 of the latch plate 46. See FIG. 3A. The pawl lever 86 retains the latch plate 46 in such latched position under the influence of return spring 68.

As noted above, only a portion of the latch mechanism 42 of this invention is illustrated in the drawings. It should be understood that a second carriage 126 is located on the opposite end of the truck box 10 which is fixed to the second actuator rod 142. In response to lateral movement of such second carriage 126, the actuator arm 134 of the second slide block 118 causes the pawl lever 86 to disengage the latch plate 46 in the same manner described above.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof.

For example, in the embodiment of this invention described above the first and second actuator rods 140 and 142 are connected to respective first and second slide blocks 116, 118 such that the slide blocks 116, 118 are pulled with a carriage 126 toward one of the end walls 16, 18. Alternatively, the first and second actuator rods 140, 142 and first and second slide blocks 116, 118 could be attached in such a way that the carriage 126 would be moved in the opposite direction so as to "push" the slide blocks 116, 118 instead of "pull" them relative to the actuator pin 96 mounted to the pawl lever 86.

Therefore, it is intended that the invention not be limited to the particular embodiment disclosed as the best mode contemplated for carrying out this invention, but that the invention will include all embodiments falling within the scope of the appended claims.

What is claimed is:

1. A latch mechanism, comprising:

a latch rail formed with a first opening, a second opening and a cavity located in between said first and second openings, said latch rail being adapted to mount to a front wall of a truck box;

a latch plate pivotally mounted to said latch rail, said latch plate being movable between a latched position and an unlatched position, said latch plate being adapted to engage a striker pin when in said latched position;

a pawl lever pivotally mounted to said latch rail, said pawl lever being movable to a first position in which said pawl lever engages and retains said latch plate in said latched position, said pawl lever being movable to a second position in which said pawl lever releases said latch plate so that said latch plate can move from said latched position to said unlatched position;

a first carriage located within said first opening of said latch rail and a second carriage located within said second opening of said latch rail;

a first slide block and a second slide block each located within said cavity of said latch rail, said first slide block mounting a first actuator arm in position to engage said pawl lever, said second slide block mounting a second actuator arm in position to engage said pawl lever;

a first actuator rod, said first actuator rod being fixed to said first carriage and fixed to said first slide block;

a second actuator rod, said second actuator rod being fixed to said second carriage and fixed to said second slide block;

said first carriage being movable in a first direction causing said first actuator rod to move said first slide block therewith, said first actuator arm mounted to said first slide block moving said pawl lever to said second position in response to movement of said first slide block in said first direction thus allowing said latch plate to move to said unlatched position;

said second carriage being movable in a second direction, opposite to said first direction, causing said second actuator rod to move said second slide block therewith, said second actuator arm mounted to said second slide block moving said pawl lever to said second position in response to movement of said second slide block in said second direction thus allowing said latch plate to move to said unlatched position.

2. The latch mechanism of claim 1 in which said pawl lever mounts an actuator pin, each of said first and second actuator arms being mounted in position to engage said actuator pin, said first actuator arm when moving in said first direction with said first slide block being effective to cause said actuator pin to move said pawl lever out of engagement with said latch plate, said second actuator arm when moving in said second direction with said second slide block being effective to cause said actuator pin to move said pawl lever out of engagement with said latch plate.

3. The latch mechanism of claim 1 in which movement of said first slide block in said first direction and movement of said second slide block in said second direction causes said pawl lever to pivot.

4. The latch mechanism of claim 1 in which said first carriage mounts a key cylinder having an inner end extending into said first opening, a locking cap being mounted to said inner end of said key cylinder, said key cylinder being movable between a locked position wherein said locking cap prevents movement of said first carriage in said first direction and an unlocked position wherein said locking cap permits movement of said first carriage in said first direction.

5. The latch mechanism of claim 1 in which said second carriage mounts a key cylinder having an inner end extending into said second opening, a locking cap being mounted to said inner end of said key cylinder, said key cylinder being movable between a locked position wherein said locking cap prevents movement of said second carriage in said second direction and an unlocked position wherein said locking cap permits movement of said second carriage in said second direction.

6. The latch mechanism of claim 1 in which each of said first and second carriages mounts a finger tab which may be grasped by a user to move said first carriage in said first direction or said second carriage in said second direction.

7. A truck box, comprising:

a front wall, a back wall, a bottom wall and opposed end walls interconnected to form a hollow interior, a lid movable between an open position and a closed position relative to said hollow interior, said lid mounting a striker pin;

a latch mechanism, comprising:

(i) a latch rail formed with a first opening, a second opening and a cavity located in between said first and second openings, said latch rail being mounted to said front wall of a truck box and extending substantially between said opposed end walls;

(ii) a latch plate pivotally mounted to said latch rail, said latch plate being movable between a latched position and an unlatched position, said latch plate being effective to engage said striker pin when in said latched position;

(iii) a pawl lever pivotally mounted to said latch rail, said pawl lever being movable to a first position in which said pawl lever engages and retains said latch plate in said latched position, said pawl lever being movable to a second position in which said pawl lever releases said latch plate so that said latch plate can move from said latched position to said unlatched position;

(iv) a first carriage located within said first opening of said latch rail and a second carriage located within said second opening of said latch rail;

(v) a first slide block and a second slide block each located within said cavity of said latch rail, said first slide block mounting a first actuator arm in position to engage said pawl lever, said second slide block mounting a second actuator arm in position to engage said pawl lever;

(vi) a first actuator rod, said first actuator rod being fixed to said first carriage and fixed to said first slide block;

(vii) a second actuator rod, said second actuator rod being fixed to said second carriage and fixed to said second slide block;

(viii) said first carriage being movable in a first direction causing said first actuator rod to move said first slide block therewith, said first actuator arm mounted to said first slide block moving said pawl lever to said second position in response to movement of said first slide block in said first direction thus allowing said latch plate to move to said unlatched position;

(ix) said second carriage being movable in a second direction, opposite to said first direction, causing said second actuator rod to move said second slide block therewith, said second actuator arm mounted to said second slide block moving said pawl lever to said second position in response to movement of said second slide block in said second direction thus allowing said latch plate to move to said unlatched position.

8. The latch mechanism of claim 7 in which movement of said first slide block in said first direction and movement of said second slide block in said second direction causes said pawl lever to pivot.

9. The latch mechanism of claim 7 in which said first carriage mounts a key cylinder having an inner end extending into said first opening, a locking cap being mounted to said inner end of said key cylinder, said key cylinder being movable between a locked position wherein said locking cap prevents movement of said first carriage in said first direction and an unlocked position wherein said locking cap permits movement of said first carriage in said first direction.

10. The latch mechanism of claim 7 in which said second carriage mounts a key cylinder having an inner end extending into said second opening, a locking cap being mounted to said inner end of said key cylinder, said key cylinder being movable between a locked position wherein said locking cap prevents movement of said second carriage in said second direction and an unlocked position wherein said locking cap permits movement of said second carriage in said second direction.

11. The latch mechanism of claim 7 in which each of said first and second carriages mounts a finger tab which may be grasped by a user to move said first carriage in said first direction or said second carriage in said second direction.

* * * * *